428-408
11/12/85 XR 4,552,243 SR

United States Patent [19]
Melillo et al.

[11] Patent Number: 4,552,243
[45] Date of Patent: Nov. 12, 1985

[54] DIAPHRAGM MATERIAL FOR ACOUSTICAL TRANSDUCER

[75] Inventors: Louis Melillo, Crystal Lake, Ill.; Tsutomu Haga, Yamagata; Iwao Sashida, Chichibushi, both of Japan

[73] Assignee: Pioneer Industrial Components, Inc., Elk Grove Village, Ill.

[21] Appl. No.: 606,624

[22] Filed: May 3, 1984

[51] Int. Cl.[4] ..... H04R 7/02
[52] U.S. Cl. ..... 181/169; 181/170; 428/408; 428/902
[58] Field of Search ..... 181/167, 169, 170; 428/408, 902

[56] References Cited

U.S. PATENT DOCUMENTS 3,930,130 12/1975 Boszor ..... 181/169 X
4,190,746 2/1980 Harwood et al. ..... 181/167 X
4,410,768 10/1983 Nakamura et al. ..... 181/169 X
4,428,996 1/1984 Miyoshi et al. ..... 428/367 X

FOREIGN PATENT DOCUMENTS 0065719 6/1978 Japan ..... 181/169
0155825 12/1979 Japan ..... 181/169
0003273 1/1980 Japan ..... 181/169

*Primary Examiner*—Benjamin R. Fuller
*Attorney, Agent, or Firm*—Richard P. Crowley

[57] ABSTRACT

An improved diaphragm material for use with an acoustical transducer, such as a moving-coil electrodynamic loudspeaker and a loud speaker containing such diaphragm, which diaphragm comprises a formed, self-supporting, woven carbon fiber cloth material optionally having a thin air sealing plastic coating thereon, the diaphragm having a sonic velocity of about $5\times10^3$ or greater and an internal loss of about 0.02 or more.

17 Claims, 4 Drawing Figures

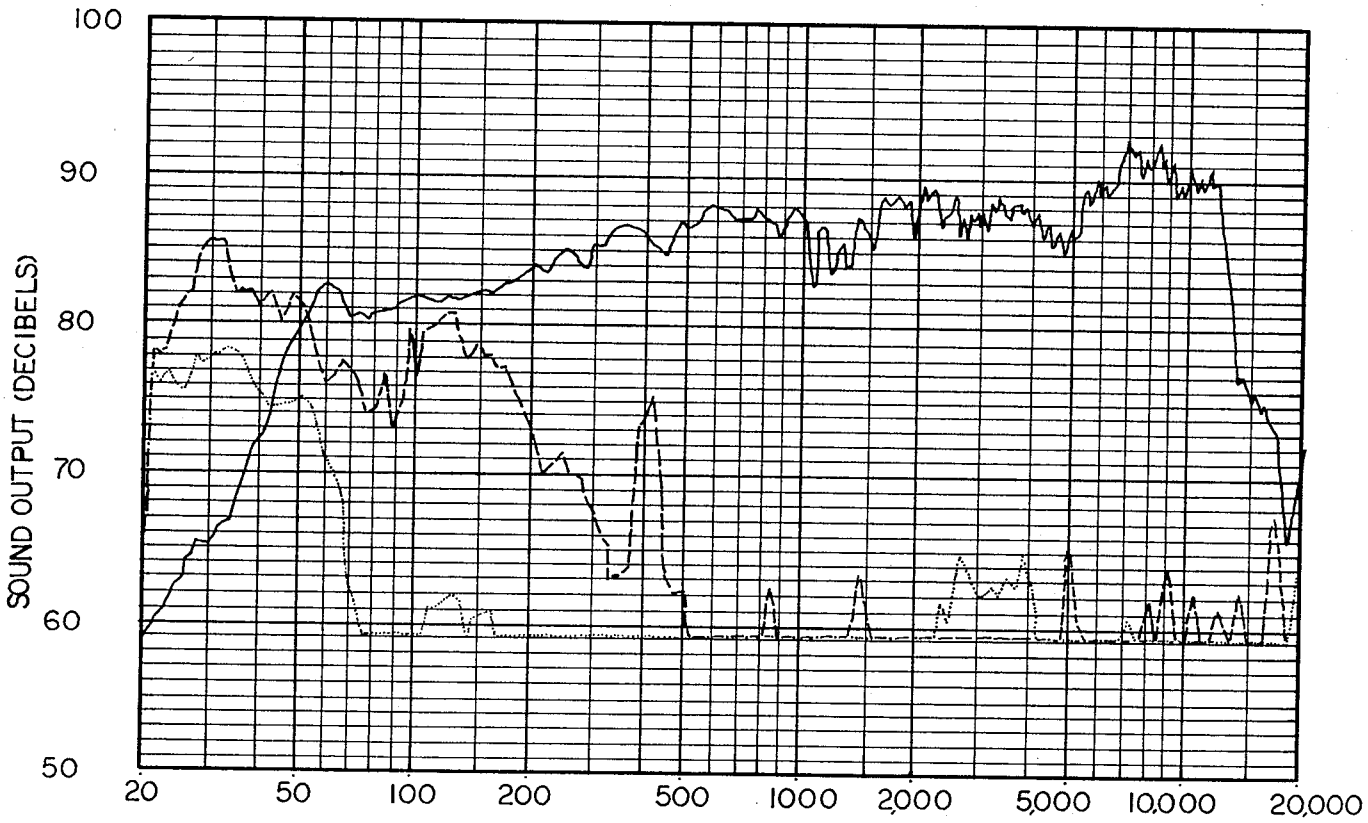
[FIG. 1] FIG. 4

DIAPHRAGM MATERIAL FOR ACOUSTICAL TRANSDUCER

BACKGROUND OF THE INVENTION

Acoustical transducers containing diaphragms are employed to transfer energy between mechanical and electrical states, and such acoustical transducers would include microphones, earphones, beepers (that is, narrow-frequency-band transducers) and loudspeakers, such as, but not limited to, electrodynamic moving-coil and piezoelectric loudspeakers, particularly high-frequency tweeters. A wide variety of material has been suggested for use as diaphragms, both alone and in various laminated and coated forms, in acoustical transducers. Typically, the diaphragm material is shaped into various cone or dome-like forms, alone or in combination, such as, for example, in hyperbolic, exponential and conical-type shapes. Generally, the shape of the diaphragm and the material of the diaphragm provide for the frequency-response characteristics of the diaphragm.

U.S. Pat. No. 4,190,746, issued Feb. 26, 1980, discloses that a wide variety of materials have been employed as diaphragms in moving-coil loudspeakers, to include: metals, ceramics, papers and various plastics in both single-coated and laminate-type forms. The diaphragm material may be laminated or integral with the surround. The patent claims that certain particular plastic materials ar suitable for use over the entire frequency range of a moving-coil loudspeaker, such as polypropylene, polyethylene and ethylene-propylene copolymers as having good damping characteristics and a Young's modulus of about 8.5 to $17.5\times10^{-5}$ and as particularly suitable materials for wide frequency responses.

Speaker diaphragms have been disclosed which employ carbon fibers as a component of the diaphragm. U.S. Pat. No. 3,930,130, issued Dec. 30, 1975 discloses nonwoven carbonized fiber webs with a high amount of stiffening resin to form a loudspeaker diaphragm. The nonwoven carbon fiber web is formed from chopped carbon fibers using paper making techniques and the web is then impregnated with a hardening resin, such as an epoxy, phenolic or melamine thermosetting resin to form a diaphragm for a loudspeaker. U.S. Pat. No. 4,291,781, issued Sept. 29, 1981 discloses a loudspeaker diaphragm made from a sheet having a wide variety of short fibers including carbon fiber, and which sheet includes short fibers of polyethylene, which are melted during the pressing operation to form the diaphragm cone or dome shape. U.S. Pat. No. 4,410,768, issued Oct. 18, 1983, prepares a composite loudspeaker diaphragm of a foamed resin which contains strengthening fibers such as glass, nylon and carbon fibers.

It is desirable to provide an improved diaphragm material and acoustical transducers, such as moving-coil loudspeakers, made using such diaphragm material which will provide improved frequency response, particularly at high frequencies, and which, while having high Young's modulus values, also are characterized by high internal loss and other desirable acoustical properties.

SUMMARY OF THE INVENTION

The invention is directed to an improved diaphragm material and to acoustical transducers using such diaphragms. In particular, the invention relates to an improved diaphragm material particularly suitable for use with high-frequency loudspeakers, which diaphragm material is composed essentially of a self-supporting woven carbon fiber material.

An improved diaphragm has been discovered, which diaphragm is suitable for use with acoustical transducers and comprises a woven carbon fiber material preferably, but, optionally, having a thin air sealant plastic coating thereon, which diaphragm material provides for a unique combination of properties, when employed as a diaphragm, in that the diaphragm materials are characterized by a high Young's modulus, low water absorbtivity and excellent internal damping characteristics or a high internal loss. In particular, acoustical transducers, such as moving-coil loudspeakers, exhibit surprisingly lower distortion at the high-frequency bands when the diaphragm of the loudspeaker is composed of the woven carbon fiber material of the invention.

Many materials, which are suggested for use and are used with diaphragm materials with loudspeakers, have high or generally unacceptable water-absorbtivity characteristics, which provides for extreme changes in the Young's modulus, resulting in extreme changes in frequency response of acoustical transducers made with such diaphragm material. As is known, the Young's modulus changes with water absorbtivity; that is, it decreases to become less stiff, resulting in changes in frequency response. Most acoustical transducer products are designed to particular specifications, such as the electronics-industry specifications, such as the Japanese Industrial Standard, and often are used in environments where the humidity changes. Thus, changes in the Young's modulus caused by humidity affect the frequency response of the acoustical transducer. The woven carbon fiber material, from which the diaphragm of the present invention is composed, exhibits very low changes in the Young's modulus with humidity; for example, in comparison to paper diaphragms, wherein large changes in the Young's modulus in paper diaphragms result in extreme changes in frequency response.

The woven carbon fiber material employed as a diaphragm has excellent damping characteristics; that is, it has a high interior loss typically of about 0.02, such as 0.05, 0.06 or more. Thus, while the woven carbon fiber material exhibits a high Young's modulus, the internal oscillations are dampened, so that it does not store easily vibration energy and tends to dampen the internal oscillations of the natural vibration frequeny. Diaphragms composed of the woven carbon fiber material, for example, exhibit an internal loss of twenty-five times that of aluminum, which has a comparable Young's modulus. Further, the diaphragm of the woven carbon fiber material, while it may have the same general internal loss as paper, exhibits a much higher Young's modulus than a plastic material, such as polyester or polypropylene, as, for example, set forth in U.S. Pat. No. 4,190,746.

The woven carbon fiber cloth material results in frequency extensions of one to two octaves higher than the corresponding plastic-material cones. The diaphragm material of the invention is particularly useful in large size loudspeakers, such as speakers over about five inches in diameter or more, including the surround or where the speaker composed of the diaphragm material is about three inches or greater. Typically, speakers with large diameter diaphragms tend to produce harmonic distortions. When the diameter of the diaphragm is greater than the wave length of the sound being produced, second and third harmonic distortions often occur. With woven carbon fiber diaphragms, the natural frequency is pushed several octaves higher, so that harmonic distortion from the second and third does not occur or is considerably less.

It has been found that the woven carbon fiber diaphragm of the invention provides a high Young's modulus, such as, for example, about $5\times10^{10}$ or more and a relatively low density, so that the sonic velocity in meters per second is about $5\times10^{3}$ or more often about $6.0\times10^{3}$ or more, which in combination with a low internal loss provides unique performance properties for a diaphragm material. Typically, prior art diaphragm material, such as composite material wherein a strengthening fiber is used in a supporting polymer matrix material, the matrix provides for good damping properties that is a high internal loss, but the matrix material considerately reduces the sonic velocity of the diaphragm material. Thus, the diaphragm materials composed of woven carbon fibers exhibit the unique combination of low water absorbtivity, a high Young's modulus, high sonic velocity, and a high internal loss provided for significant functional advantages and performance properties over the use of prior art paper, metal, plastic and composite diaphragm-type materials.

The diaphragm material of the invention should comprise a diaphragm of the desired form, typically and generally in dome or cone form, in which the diaphragm is composed of a tightly woven carbon fiber material having a very close weave, with a minimum of air space or no air space between the fiber weave. Optionally and preferably, the woven carbon fiber diaphragm material is sealed by thin laminations or coatings on one or both sides, so as to prevent air from passing through the diaphragm, which may contribute to a lower internal loss. The woven carbon fiber diaphragm material results in a high internal loss, while maintaining a Young's modulus and internal loss about or nearly equal to aluminum, which results in a very low distortion at high frequencies, making the diaphragm material particularly useful in tweeters. The diaphragm material provides for a very smooth, extended, high-frequency response, in that the frequency response will be higher than the corresponding prior-art paper or polypropylene diaphragm, while the woven carbon fiber diaphragm will approach a bell mode and without finite variations in frequency responses.

The woven carbon fiber material of the diaphragm typically composed over 80 percent, for example, over 90 to 95 percent by volume of the diaphragm and preferably is tightly woven, to reduce the amount of air passing through the diaphragm in operation. The weave of the woven cloth may vary and may comprise threads composed of a single or multiple carbon fiber and be composed, if desired, of a single or multiple layer. Generally, the woven cloth material is woven on a loom in a tightly woven manner. The weave structure may comprise a plain weave (which is preferred), twill weave, plain dutch weave, twilled dutch weave, herringbone twill weave, double-crimp, intermediate-crimps, lock-crimps, or smooth-top-type or other weave patterns. The threads used may be the same or different in size, but generally are of the same or about the same diameter and composition. For example, the vertical and horizontal threads may vary from about 250 or more threads per meter, such as from about 450 to 950 threads per meter with a woven cloth thickness of about 0.15 to 50 mm, such as 0.15 to 30 mm.

Preferably, the woven carbon fiber material is sealed or laminated on one or both sides with a thin coating layer of another material, such as metal, plastic or ceramic material, in order to control the desired damping characteristics of the diaphragm material. The selection of a particular sealing material on the woven carbon fiber material controls to some degree the amount of internal loss by the properties of the sealing material. For example, where the woven carbon fiber material comprises a generally similar warp and woof of under-and-over woven, i.e. plain weave cloth material, a sealing coat of a plastic material may be applied to one side of the woven cloth material.

A sealing material may be applied in the form of a lacquer or solvent coating composed of one or more polymeric materials or blends of natural or synthetic polymeric materials, such as, for example, a solvent solution of a vinyl halide resin, such as a polyvinyl chlordie, which may be applied to one side to seal any air openings between the woven cloth to prevent the passage of air through the woven cloth diaphragm. The sealing composition may compose a lacquer, plastisol, organosol, latex or other liquid to also provide for a shiny, aesthetically pleasing face finish to the woven cloth material, while, with the removal of the liquid carrier provides for the polymeric material to fill in between the warp and woof, to provide an effective air sealer coat.

The plastic coating may be sufficient merely to prevent the passage of air or may be controlled in thickness; for example, 0.5 to 10 mils or used in higher thickness for example 1–3 mils, in order to provide for further control over the internal loss characteristics of the diaphragm material. While the sealing solution or coating composition may be applied to one or both sides, sealing also may be accomplished by laminating thin sheets of cloth, paper, ceramics, metal-like aluminum or polymers to one or both sides of the same or different material of the woven cloth material, to provide a composite diaphragm material of desired characteristics. Very thin coating or laminate materials may be employed to modify and to enhance the properties of the woven cloth carbon fiber material employed.

The sealed or laminated woven-carbon fiber material employed as a diaphragm also may be used in conical or dome form, honeycomb or other form, and, where a conical diaphragm is employed, together with a dome diaphragm, the dome material may be the same as the conical material or a different material. The diaphragm material may be integral with the transducer or may have a surround. The surround material may be composed of a variety of materials, such as cloth, paper, elastomeric material or foam material, in order to provide some flexibility about the perimeter of the diaphragm material. It is essential that the diaphragm material be composed of a woven carbon fiber material, in order to provide the unique desirable combination of properties suitable for use in acoustical diaphragm materials. Thus, the employment of a majority amount of polymeric material as a matrix, or sufficient materials either sealed or laminated to alter disadvantageously the desirable unique properties of the woven cloth carbon fiber material, should be avoided. The diaphragm material of the invention may be used with any acoustical driving means, such as the diaphragm cone of an electrodynamic moving-coil loudspeaker, such as illustrated in U.S. Pat. No. 4,190,746 or in combination with and as the diaphragm material with a piezoelectric, mono or bimorph wafer element.

The materials employed to provide an effective air seal for the woven carbon fiber materials of the invention would comprise, but not be limited to, those plastic materials, either applied as a coating or as a laminate in very thin form, such as, for example, acrylic resins, olefin resins like polypropylene, polyethylene, ethylene-propylene copolymers, polyamides like nylon, vinyl halides, resins like vinylchloride plastisols, polyvinyl acetates, ethylene-vinyl acetate polymers, styrene and styrene copolymers, uerethane resins and elastomeric materials.

The woven carbon fiber material used on the diaphragm material may comprise a crystalline-type graphite carbon fiber composed essentially of substantially 100 percent carbon and may be isotropic or anisotropic carbon. The carbon fiber used generally may vary in diameter and length. Also the type of weave may vary, provided that a woven material is obtained which is generally self-supporting in nature. Unlike U.S. Pat. No. 3,930,130, the diaphragm material requires no large amounts of resin to provide structural support and strength, since the woven carbon fiber provides the structural support and the plastic coating where used, is employed to seal out air from passing through the woven fiber and to control internal loss. The diaphragm may be formed in the desired structural shape such as in a generally structural form and then coated, and later the smaller dome secured over the center of the conical diaphragm.

The invention will be described for the purpose of illustration only in connection with certain embodiments; however, it is recognized that various additions, changes and modifications may be made to the illustrated embodiments by those persons skilled in the art, all falling within the spirit and scope of the invention.

BRIEF DESCRIPTION OF THE DRAWINGS

FIG. 4 is a graphical representation of the output in decibels versus the frequency response in hertz of a loudspeaker having a diaphragm cone material of the invention.

DESCRIPTION OF THE EMBODIMENTS

Figure 1:
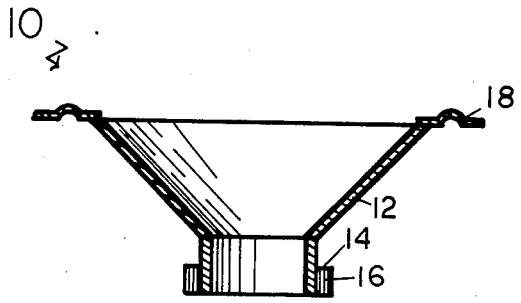
FIG. 1 is a diagrammaticial, vertical, sectional view of a loudspeaker with a diaphragm of the invention.

FIG. 1 is a diagrammatical view of an electrodynamic moving coil loudspeaker 10 which comprises a generally concical carbon-fiber diaphragm 12 of the invention, a voice coil bobbin 14, and a voice coil 16 wound about the voice coil bobbin 14, and a surround 18 about the periphery of the diaphragm 12.

Figure 2:
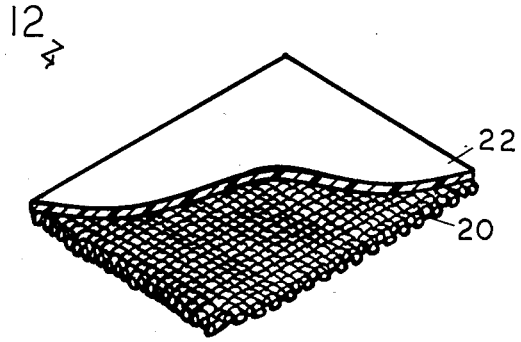
FIG. 2 is a diagrammatical enlarged perspective view of the diaphragm of the loudspeaker of FIG. 1.
Figure 3:
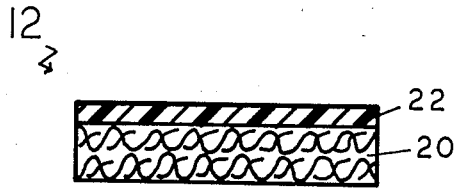
FIG. 3 is an enlarged sectional view of the diaphragm of the loudspeaker of FIG. 1.

FIGS. 2 and 3 are enlarged views of the diaphragm 12 of FIG. 1 wherein the diaphragm comprises a tightly-woven, close-weave, self-supporting carbon fiber woven cloth material 20 with a thin air-sealing and internal loss controlling layer of a plastisol coating 22 on one surface of the cloth material, which plastisol layer seals any air passages in the tightly-woven cloth material 20 and also controls the internal loss of the diaphragm.

A carbon fiber woven cloth material obtained from Toho-Rayon Corporation of Chuo-Ku, Tokyo, Japan and known as Besfight Model No. 113 and 3101, both of plain weave structure were used to prepare truncated, conical diaphragms for an electrodynamic moving-coil loudspeaker. Model 1103 cloth used base threads 1000F, with 906 threads per meter and had a thickness of 0.16 mm, while Model 3101 cloth used threads 3000F with 492 threads per meter and had a thickness of 0.25 mm. One side (inside of cone) of the conical woven cloth contained a thin layer of a thin vinychloride plastisol air-sealing coating.

A moving coil electrodynamic loudspeaker of $5\frac{1}{4}$ inches with a cone of $3\frac{3}{8}$ inches with a plastisol coated, plain weave, woven cloth diaphragm material as the truncated cone (similar to the loudspeaker of U.S. Pat. No. 4,190,746) was then tested and the output of the loudspeaker in decibels as the ordinate plotted against the frequency response as the abscissa with the graphical results are shown in the drawing with a constant voltage input of 2.82 volts, the material having a natural resonance frequency at 72 hertz. As shown by the drawing, the decibel output of the loudspeaker was fairly constant over the range of about 60 hertz to 12 kilo hertz. The roll off at the first natural frequency mode of the speaker is about 19 kh. The low amount of frequency distortion is illustrated by the dash line illustration, the second harmonic distortion (2×fundamental) and the dotted line illustrating the third harmonic distortion (3×fundamental). In order to place the second and third harmonic on the same graph as the fundamental harmonic, the graphical results were raised by 20 decibels. As illustrated, the fundamental harmonic is rather constant, while the second and third harmonic level of distortion remain very low especially in the frequency region above the normal piston mode, which illustrates the unexpected and high performance characteristics of the loudspeaker with the woven cloth carbon fiber diaphragm of the invention.

Table I illustrates the comparison in representative physical properties of various materials used as diaphragm cones, including the carbon fiber woven cloth material.

TABLE 1

PHYSICAL PROPERTIES OF MATERIALS FOR DIAPHRAGMS

| Cone Type Material | Young's Modulus $E(N/m^2)$ | Density $\rho(Kg/m^3)$ | Sonic Velocity $\sqrt{E/\rho}$ (m/s) | Internal Loss tan δ |
|---|---|---|---|---|
| Composite* | $7.0 \times 10^{10}$ | $1.8 \times 10^3$ | $6.2 \times 10^3$ | 0.05 |
| Aluminum | $7.0 \times 10^{10}$ | $2.7 \times 10^3$ | $5.1 \times 10^3$ | 0.002 |
| Titanium | $11.0 \times 10^{10}$ | $4.5 \times 10^3$ | $4.9 \times 10^3$ | 0.002 |
| Cone Paper | $0.2 \times 10^{10}$ | $0.5 \times 10^3$ | $2.0 \times 10^3$ | 0.05 |
| Boronized Titanium | $27 \times 10^{10}$ | $4.2 \times 10^3$ | $15 \times 10^3$ | 0.002 |
| Berylium | $14.7 \times 10^{10}$ | $1.8 \times 10^3$ | $12.3 \times 10^3$ | 0.002 |
| Glass Fiber Pulp | $1.5 \times 10^{10}$ | $1.4 \times 10^3$ | $3.2 \times 10^3$ | 0.04 |
| Polyester | $0.1 \times 10^{10}$ | $1.0 \times 10^3$ | $1.0 \times 10^3$ | 0.04 |
| Poly-propylene | $0.16 \times 10^{10}$ | $1.0 \times 10^3$ | $1.3 \times 10^3$ | 0.05 |
| Woven Carbon Fiber Cloth | $6.8 \times 10^{10}$ | $1.7 \times 10^3$ | $6.3 \times 10^3$ | 0.05 |

*Nylon loaded with carbon fibers

As shown, the carbon fiber woven cloth diaphragm material combines high sonic velocity with good internal loss properties, while prior art metals like aluminum, berylium, and boronized titanium have desirable high Young's modulus, their internal loss and dampening characteristics are unacceptably low. While prior art paper, polypropylene, and polyester cones have acceptable internal loss, the sonic velocity is low. The carbon fiber cloth diaphragm material is shown to possess the desired combination of properties for a loudspeaker cone.

The composite material, while having good sonic velocity and internal loss, tends to be quite brittle and stiff, while the woven structure of the carbon fiber woven cloth material is more desirable and possesses better mechanical properties, is generally less expensive to manufacture, and in particular, does not have the problems associated with the compounding and molding of the composite material.

Table II illustrates the resistance to humidity with time of woven carbon fiber material with times of the woven cloth material in comparison to paper cones.

TABLE II

RESISTANCE TO HUMIDITY

| Cone Type | % Water Absorption Young's Modulus | Start | After 1 Day | After 4 Days | After 7 Days |
|---|---|---|---|---|---|
| Besfight Carbon Cloth | Absorption of water in % | — | 0 | 0.05 | 0.08 |
| | E ($N/M^2$) | $6.8 \times 10^{10}$ | $6.8 \times 10^{10}$ | $6.9 \times 10^{10}$ | $7.0 \times 10^{10}$ |
| Paper | Absorption of water in % | — | 6.3 | 7.0 | 7.7 |
| | E ($N/M^2$) | $0.2 \times 10^{10}$ | $0.17 \times 10^{10}$ | $0.15 \times 10^{10}$ | $0.12 \times 10^{10}$ |

As illustrated, the carbon fiber woven cloth material, unlike paper, does not result in extreme changes in Young's modulus and frequency response with a change in humidity.

What is claimed is:

1. A diaphragm for use in an acoustical transducer or loudspeaker, which diaphragm comprises: a tightly-woven, close-weave, self-supporting, carbon fiber woven cloth material and a thin air sealing layer on one or both sides of the woven carbon fiber cloth material to control the internal loss characteristics of the diaphragm and to seal the passage of air through the cloth material, the woven carbon fiber cloth material comprising about 80 percent by volume or more of the volume of the diaphragm, and which diaphragm has a sonic velocity of about $5\times10^3$ meters per second or greater and a controlled internal loss of about 0.05 (tan $\sigma$) or more.

2. The diaphragm of claim 1 wherein the air-sealing layer is a thin polymeric coating.

3. The diaphragm of claim 1 wherein the air-sealing layer is a vinyl halide plastisol coating.

4. The diaphragm of claim 1 wherein the carbon fiber woven cloth material has from about 450 to 950 threads per meter and has a thickness of about 0.15 to 60 mm.

5. The diaphragm of claim 1 wherein the Young's modulus of the woven carbon fiber cloth material comprises about $5\times10^{10}$ $N/m^2$ or higher.

6. The diaphragm of claim 1 wherein the diaphragm is characterized by a generally truncated, conical form and has a sonic velocity of about $6.3\times10^{10}$ meters per second or higher and an internal loss of about 0.05 (tan $\sigma$) or more, and wherein one or both sides of the woven carbon fiber material has been sealed against the passage of air by a thin plastic coating as the air-sealing layer.

7. The diaphragm of claim 1 wherein the air-sealing layer has a thickness of about 0.5 to 10 mils.

8. The diaphragm of claim 1 wherein the carbon fibers consist essentially of 100 percent carbon.

9. The diaphragm of claim 1 wherein the carbon fibers are graphite carbon fibers.

10. The diaphragm of claim 1 wherein the woven carbon fiber cloth material comprises about 90 percent by volume or more of the diaphragm.

11. The diaphragm of claim 1 wherein the woven carbon fiber cloth is composed of a plain weave having about 250 threads per meter or more in the horizontal and vertical direction.

12. An acoustical transducer which comprises an acoustical driving means and a diaphragm driven by the driving means, the diaphragm composed of the diaphragm of claim 1.

13. The acoustical transducer of claim 12 wherein the acoustical transducer comprises a high-frequency electrodynamic loudspeaker with a moving coil as the driving means.

14. The acoustical transducer of claim 12 wherein the diaphragm has a diaphragm diameter of about 3 inches or more.

15. A diaphragm for an acoustical transducer which consists essentially of a formed, tightly-woven, close-weave, self-supporting carbon fiber cloth material, the carbon fiber composed of a crystalline graphite of essentially 100 percent carbon, the carbon fiber comprising about 90 percent by volume or more of the diaphragm, and having a sonic velocity of about $5\times10^3$ meters per second or greater and an internal loss of about 0.05 (tan $\sigma$) or more, and which includes a thin air-sealing layer of a plastic coating on one or both sides of the woven carbon fiber material to control the internal loss characteristics of the diaphragm and to seal the passage of air through the cloth material.

16. An electrodynamic loudspeaker which comprises a moving coil as a driving means and a truncated, conical diaphragm driven by the driving means, the diaphragm composed of the diaphragm of claim 15.

17. The loudspeaker of claim 16 wherein the diaphram has a roll off at about 19 kh or higher and substantially little second and third harmonic frequency distortions.

* * * * *